United States Patent [19]

Kurtz et al.

[11] 4,028,514

[45] June 7, 1977

[54] HIGH CURRENT VACUUM CIRCUIT INTERRUPTER WITH BERYLLIUM CONTACT

[75] Inventors: Donald R. Kurtz; Carl C. Popadick, both of West Chester; Joseph C. Sofianek, Broomall; Joseph L. Talento, Media, all of Pa.

[73] Assignee: General Electric Company, Philadelphia, Pa.

[22] Filed: Dec. 3, 1974

[21] Appl. No.: 529,178

[52] U.S. Cl. ..... 200/144 B; 200/270

[51] Int. Cl.[2] ..... H01H 33/66; H01H 1/02

[58] Field of Search ..... 200/144 B, 262–270, 200/279; 313/311; 75/138, 150

[56] References Cited

UNITED STATES PATENTS

| | | | |
|---|---|---|---|
| 2,949,520 | 8/1960 | Schneider | 200/279 X |
| 3,140,373 | 7/1964 | Horn | 200/270 X |
| 3,234,351 | 2/1966 | Hebb | 200/144 B |
| 3,246,979 | 4/1966 | Lafferty et al. | 75/138 X |
| 3,327,081 | 6/1967 | Pflanz | 200/144 B |
| 3,497,755 | 2/1970 | Horn | 313/311 |
| 3,522,399 | 7/1970 | Crouch | 200/144 B |
| 3,546,407 | 12/1970 | Schneider | 200/144 B |
| 3,624,325 | 11/1971 | Horn et al. | 200/144 B |
| 3,821,505 | 6/1974 | Wood | 200/144 B |
| 3,825,789 | 7/1974 | Harris | 200/144 B |

FOREIGN PATENTS OR APPLICATIONS

| | | |
|---|---|---|
| 1,025,943 | 4/1966 | United Kingdom |
| 1,025,944 | 4/1966 | United Kingdom |

OTHER PUBLICATIONS

G. E. Meyer et al., "Beryllium Ingot Sheet and Other Wrought Forms", Metallurgical Society Conferences, vol. 33, Beryllium Technology, vol. 1, pp. 589–612, Science Publishers, Inc., 1966.

The Beryllium Corporation, "New Beryllium Sheet Offer Greater Ductility, Ease of Fabrication", Publicity Department Release, BRL 6418, pp. 1–8(all), Feb. 1965.

John P. Denny et al., "Casting Beryllium Ingots and Shapes", Metallurgical Society Conferences, vol. 33, Beryllium Technology, vol. 2, pp. 807–824, Science Publishers, Inc., 1966.

*Primary Examiner*—James R. Scott

*Attorney, Agent, or Firm*—William Freedman

[57] ABSTRACT

A vacuum-type circuit interrupter rated to interrupt currents of 30,000 amperes r.m.s. and highercomprises a pair of separable contacts having arcing portions between which arcs are formed upon disengagement of said contacts. These arcing portions are of a material consisting essentially of beryllium formed from a vacuum-cast ingot that has been subjected to hot working by extrusion to produce a microstructure characterized by grains much smaller on the average than the grains of the as-cast ingot.

14 Claims, 7 Drawing Figures

ABOUT 100X

CAST AND EXTRUDED BERYLLIUM

30X

AS-CAST BERYLLIUM INGOT

ABOUT 100X

CAST AND EXTRUDED BERYLLIUM

HIGH CURRENT VACUUM CIRCUIT INTERRUPTER WITH BERYLLIUM CONTACT

BACKGROUND

This invention relates to a vacuum-type circuit interrupter and, more particularly, to a vacuum-type circuit interrupter that is capable of interrupting exceptionally large amounts of current (e.g., 30,000 amperes r.m.s. and higher) between separable contacts of a simple configuration.

References of interest with respect to this invention are the following: U.S. Pat. Nos. 3,140,373-Horn; 3,825,789-Harris; 3,497,755-Horn; and 3,624,325-Horn; and British Pat. Nos. 1,025,943-General Electric Co. and 1,025,944-General Electric Co.

For many years there have been intensive research and development efforts in the vacuum circuit interrupter field aimed at increasing the amount of current that such interrupters can successfully interrupt. The primary approach to this goal has been to develop special configurations and designs of contacts and electrodes capable of providing the desired current-interrupting capacity. While some of these designs appear quite promising, most are subject to the disadvantage that they are quite complex and consume a relatively large amount of space, both of which factors result in substantially increased manufacturing costs.

SUMMARY

An object of our invention is to achieve a very high current-interrupting capacity in a vacuum interrupter with contacts of a relatively simple and compact configuration.

Another object is to achieve the object of the immediately-preceding paragraph by using for the arcing portion of the interrupter's contacts a material consisting essentially of beryllium.

The most common method of making beryllium parts is from beryllium powders that are pressure-compacted at elevated temperature in vacuum. Processes for making and utilizing such powders are described in the book "Beryllium, Its Metallurgy and Properties", edited by H. H. Hausner and published by the University of California Press, Berkeley, Cal., in 1965. Of special interest is chapter 4*a* in this book, which is an article by Hausner entitled "Powder Metallurgy of Beryllium". In developmental work preceding the present invention, vacuum interrupter contacts of beryllium have been made from such powders compacted at an elevated temperature in vacuum. These powders were obtained from high-purity vacuum-melted ingots. When such interrupters were tested, they demonstrated current-interrupting capacity substantially above that obtainable with copper or copper-base contacts of corresponding size. But there are some applications where this current-interrupting capacity is still not sufficiently high.

Another object of our invention is to provide current-interrupting capacity substantially in excess of that presently obtainable with correspondingly-sized beryllium contacts made from beryllium powders.

Still another object is to attain the object of the immediately preceding paragraph with a contact material that is highly resistant to welding, even under the most severe contact-welding conditions encountered by an interrupter and, moreover, is highly resistant to mechanical damage even when subjected to the mechanical forces typically present in a high current interrupter rated for interrupting currents of 30,000 amperes r.m.s. or more.

In carrying out the invention in one form, we provide a vacuum interrupter rated to interrupt currents of at least 30,000 amperes. We make the arcing portions of the two vacuum interrupter contacts of a material consisting essentially of beryllium formed from an ingot cast in an inert environment, which ingot has been subjected to hot working, as by extrusion, that reduces its average grain size to a value much smaller than that of the as-cast ingot. The beryllium of said arcing portions has a microstructure characterized by grain boundaries that are substantially free of oxide coating on the interfaces between the grains.

BRIEF DESCRIPTION OF DRAWINGS

For a better understanding of the invention, reference may be had to the following description taken in conjunction with the accompanying drawings, wherein.

DESCRIPTION OF PREFERRED EMBODIMENT

Figure 1:
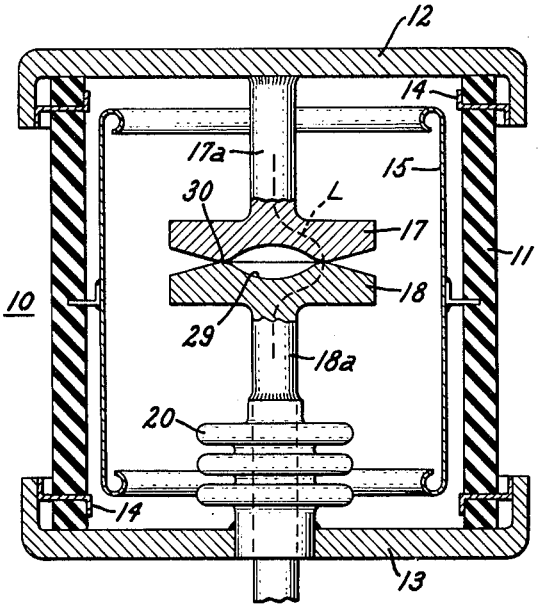
FIG. 1 is a sectional view of a vacuum-type circuit interrupter embodying one form of the invention.

Referring now to the interrupter of FIG. 1, there is shown a highly-evacuated envelope 10 comprising a casing 11 of a suitable insulating material, such as glass, and a pair of metallic end caps 12 and 13, closing off the ends of the casing. Suitable seals 14 are provided between the end caps and the casing to render the envelope 10 vacuum-tight. The normal pressure within the envelope 10 under static conditions is lower than $10^{-4}$mm. of mercury so that a reasonable assurance is had that the mean free path for electrons will be longer than the potential breakdown paths in the envelope.

The internal insulating surfaces of casing 11 are protected from the condensation of arc-generated metal vapors thereon by means of a tubular metallic shield 15 suitably supported on the casing 11 and preferably isolated from both end caps 12 and 13. This shield acts in a well-known manner to intercept arc-generated metallic vapors before they can reach the casing 11.

Located within the envelope 10 is a pair of separable contacts 17 and 18, shown in FIG. 1 in their engaged or closed-circuit position. The upper contact 17 is a stationary contact suitably attached to a conductive rod 17*a*, which at its upper end is united to the upper end cap 12. The lower contact 18 is a movable contact joined to a conductive operating rod 18*a* which is suitably mounted for vertical movement. Downward motion of the contact 18 separates the contacts and opens the interrupter, whereas return movement of contact 18 reengages the contacts and thus closes the interrupter. The operating rod 18*a* projects through an opening in the lower end cap 13, and a flexible metallic bellows 20 provides a seal about the rod 18*a* to allow for vertical movement of the rod without impairing the vacuum inside the envelope 10. As shown in FIG. 1, the bellows 20 is secured in sealed relationship at its respective opposite ends to the operating rod 18*a* and the lower end cap 13.

All of the internal parts of the interrupter are substantially free of surface contaminants. These clean surfaces are obtained by suitably processing the interrupter, as by baking it out during its evacuation. A typical bakeout temperature is 400° C.

Although my invention is not limited to any particular contact configuration, I prefer to use a contact configuration of the general type disclosed and claimed in U.S. Pat. No. 2,949,520, Schneider, assigned to the assignee of the present invention. Accordingly, each contact is of a disc shape and has one of its major surface facing the other contact. The central region of each contact is formed with a recess 29 in this major surface and an annular circuit-making and arc-initiation region 30 surrounds this recess. These annular regions 30 abut against each other when the contacts are in their closed position of FIG. 1, and are of such a diameter that the current flowing through the closed contacts follows a loop-shaped path L, as is indicated by the dotted lines of FIG. 1. Current flowing through this loop-shaped path has a magnetic effect which acts in a known manner to lengthen the loop. As a result, when the contacts are separated to form an arc between the areas 30, the magnetic effect of the current flowing through the path L will impel the arc radially outward.

Figure 2:
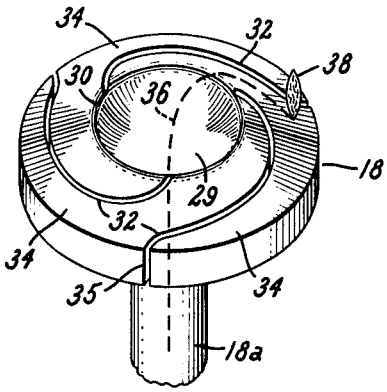
FIG. 2 is an enlarged perspective view of one of the contacts of the interrupter of FIG. 1.

As the arc terminals move toward the outer periphery of the discs 17 and 18, the arc (shown at 38 in FIG. 2) is subjected to a circumferentially-acting magnetic force that tends to cause the arc to move circumferentially about the central axes of the disks. This circumferentially-acting magnetic force is produced by a series of slots 32 provided in the discs and extending from mouths 35 at the outer periphery of the discs radially inward by generally spiral paths, as is shown in FIG. 2. The slots 32 divide each contact into a plurality of circumferentially spaced fingers 34, each bounded by a pair of slots 32. These slots 32 correspond to similarly designated slots in the aforementioned Schneider patent and thus force the current flowing to or from an arc terminal located at substantially any angular point on the outer peripheral region of the disk to follow a path, such as shown at 36 in FIG. 2, that has a net component extending generally tangentially with respect to the periphery in the vicinity of the arc. This tangential configuration of the current path results in the development of a net tangential force component, which tends to drive the arc 38 in a circumferential direction about the contacts. In certain cases, the arc may divide into a series of parallel arcs, and these parallel arcs move rapidly about the contact surface in a manner similar to that described hereinabove.

Figure 4:
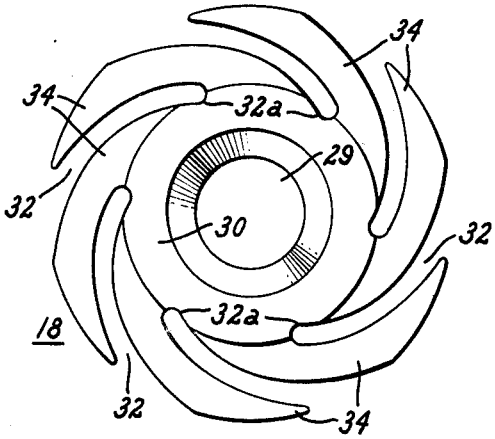
FIG. 4 is an enlarged end view of one of the contacts taken along the line 4—4 of FIG. 3.
Figure 3:
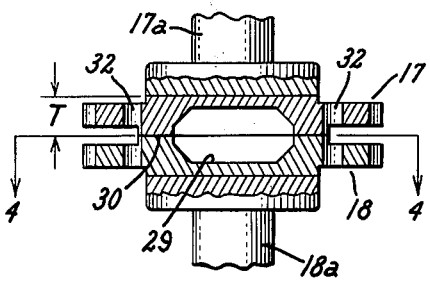
FIG. 3 is a sectional view of the contact structure of a modified embodiment of the invention.

FIGS. 3 and 4 illustrate a modified contact configuration which operates in substantially the same manner as described hereinabove with respect to the configuration of the Schneider patent. Corresponding parts of the two sets of contacts have been assigned the same reference numerals. The configuration of FIGS. 3 and 4 is similar to that shown in U.S. Pat. No. 3,462,572-Sofianek, assigned to the assignee of the present invention, except that the slots 32 shown in FIG. 4 do not extend quite as far radially inward as in the Sofianek patent and are not bridged at their inner ends 32*a* by the annular contact-making region 30 as in the Sofianek patent. A more specific description of the mode of operation of contacts such as shown in FIGS. 3 and 4 is contained in lines 1–39, column 3 of the Sofianek patent.

It will be noted that each of the illustrated contacts is a disc that extends radially outward well beyond the outer perimeter of its supporting rod. The thickness of the disc is its dimension extending longitudinally of the rods, as indicated by the dimension T in FIG. 3.

As pointed out hereinabove, an object of our invention is to achieve very high current-interrupting capacity with contacts of a relatively simple and compact configuration. The contacts shown in FIGS. 1 through 4 are examples of contacts of such configuration. We are able to attain very high current interrupting capacity with contacts such as these by making the contacts of a material consisting essentially of beryllium, formed from a vacuum cast ingot that has been subjected to hot working, e.g., extrusion. Beryllium of generally this type is described in a paper by Meyer et al, Beryllium Ingot Sheet and Other Wrought Forms, in Metallurgical Society Conferences, Vol. 33, Beryllium Technology, Vol. 1, pages 589–612, published in 1966 by Gordon and Breach, Science Publishers, Inc., New York, N. Y.

The ingot from which this beryllium material is formed can be made by vacuum induction melting high-purity electrolytic flake beryllium in a beryllium oxide crucible, and then, while under vacuum, pouring the melt into a graphite or other suitable mold and then cooling in such a way as to effect controlled directional solidification from the bottom to the top of the mold to form a sound, ingot. This ingot-making process is described in more detail in a paper by Denny et al, Casting Beryllium Ingots and Shapes, in Metallurgical Society Conferences, Vol. 33, Beryllium Technology, Vol. 2, pages 807–824, published in 1966 by Gordon and Breach, Science Publishers Inc., New York, N. Y. Other suitable techniques for producing the ingot are referred to hereinafter.

Figure 6:
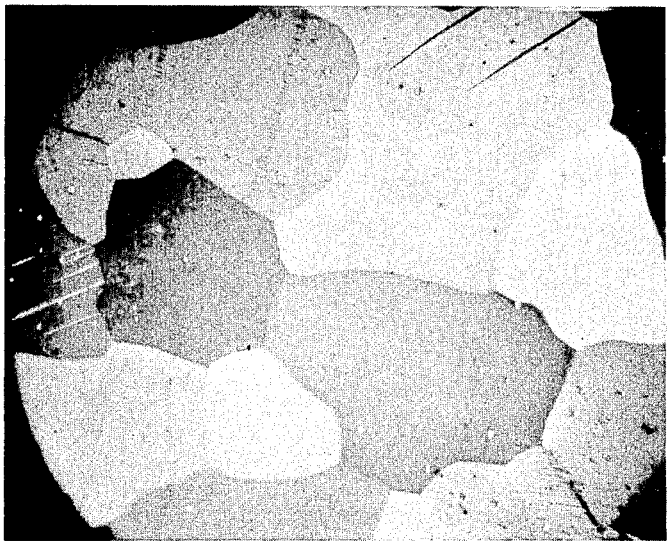
FIG. 6 is a photomicrograph at 30 magnifications of the microstructure of a high purity beryllium ingot in its as-cast form.
Figure 7:
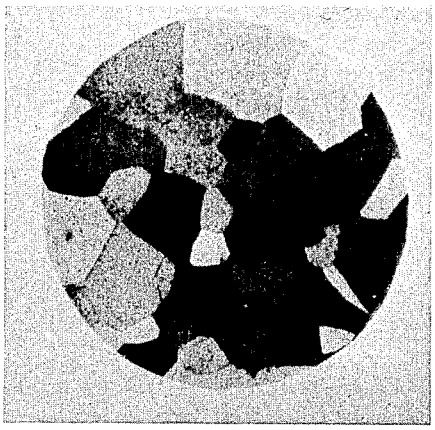
FIG. 7 is a photomicrograph at about 100 magnifications of the microstructure of an extrusion produced by extruding while hot an ingot of cast high-purity beryllium such as illustrated in FIG. 6.

After the ingot is thus formed, it is jacketed in a mild steel container and the container is evacuated and sealed. Then the jacketed ingot is hot worked by extrusion, which converts the ingot into a flattened slab or other suitable shape having its grains oriented in the direction of extrusion, after which the jacket is suitably removed, as by pickling. This jacketing and extruding process is described in more detail in the hereinabove-mentioned paper by Meyer et al. It is pointed out in the Meyer et al paper that the microstructure of the cast extruded material is characterized by generally equiaxed grains much smaller in average size than the grains of the as-cast material. Meyer et al describes the average grain size of an extrusion reduced by 12:1 at 1950° F as between 92 and 103 microns and the grains of the as-cast ingot as varying in size from 0.4 mm to 1.5 mm transversely and 0.8 mm to 1.70 mm longitudinally. This amounts to roughly a 1000 to 1 reduction in grain size on a volume basis as a result of extrusion. This reduction in average grain size will be apparent from FIGS. 6 and 7. FIG. 6 is a photomicrograph at 30 magnifications showing the microstructure of a typical as-cast beryllium ingot made as described hereinabove, whereas FIG. 7 is a photomicrograph at 100 magnifications showing the microstructure of such an ingot after it had been hot worked through extrusion as described hereinabove in this paragraph.

After removal of the jacket following the above-referred-to extrusion process, circular discs having the general shape of the contacts 17 and 18 are cut out of the extruded slab, following which these discs are suitably machined into the final contact configuration depicted in FIGS. 1–.

An interrupter having contacts made in this manner has demonstrated that it can successfully interrupt more than 55,000 amperes r.m.s. at a voltage of 31 KV, single phase test voltage. This is in marked contrast to the performance of interrupters that are otherwise the same except that their contacts are made of beryllium formed by the powder metallurgy techniques referred to in the introductory portion of this specification. These latter interrupters typically have demonstrated an interrupting capacity of only about 40,000 amperes at a corresponding voltage, i.e., 31 KV, single phase test voltage.

Figure 5:
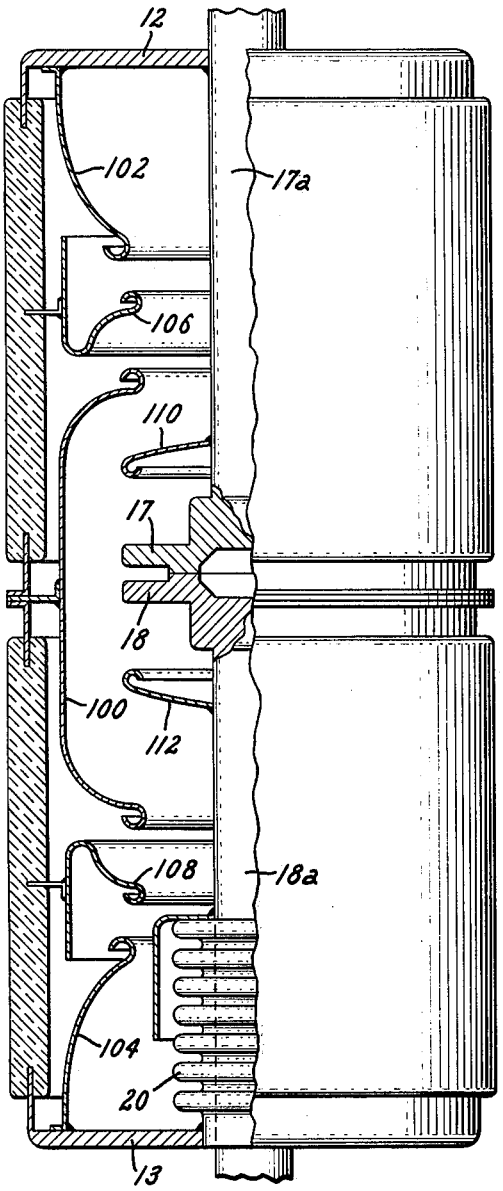
FIG. 5 is a sectional view of a vacuum interrupter including the contacts of FIGS. 3 and 4 on which certain comparative tests have been performed.

Each of the compared interrupters of the preceding paragraph had contacts of substantially the same size and design and an envelope with shielding of substantially the same size and design. The contacts were substantially the same as those shown in FIGS. 3 and 4, and the envelopes and shielding were of substantially the design shown in FIG. 5. The shielding in FIG. 5 comprises a central shield 100 normally electrically isolated from both contacts 17 and 18, end shields 102 and 104 respectively connected to end caps 12 and 13, and intermediate shields 106 and 108. Each intermediate shield is electrically isolated from the central shield and the adjacent end shield. Each of these five shields 100, 102, 104, 106, and 108 is of metal and of a tubular configuration. Additional metal shields 110 and 112 of disc form are provided on the contact rods 17*a* and 18*a* of FIG. 5 in locations behind the contacts 17 and 18.

It should be recognized that the extruded slab out of which the contact discs are cut is not a thin sheet or foil. In one embodiment of the invention, the contact has a thickness T, as shown in FIG. 3, of approximately one-half inch, thus requiring that the slab be of at least this thickness.

An important difference between beryllium formed by extruding a vacuum-cast ingot and beryllium formed from sintered powders can be found in the grain boundaries of the microstructure. In the material formed from sintered powders, there is a beryllium oxide (BeO) coating around each of what were the original powder particles, whereas in the vacuum-cast extruded material, there is no such oxide coating around the grains. The vacuum-cast extruded material still contains some beryllium oxide, but it is distributed throughout the material, appearing mostly as particles within the much larger grains that are present. Typically, the percentage of BeO present in the vacuum-cast extruded material is about 0.01 to 0.03 percent by weight as compared to about 0.4 to 1 percent by weight in beryllium hot pressed from powders.

An important property of our contacts is that they have a high resistance to contact-welding. As pointed out in U.S. Pat. No. 3,624,325-Horn, a high resistance to welding is especially important for a high-current interrupter because when the contacts are driven into closed position, they often bounce apart a short distance immediately after initial impact and then rebound toward each other, aided by closing force applied to the movable contact. An arc is drawn when the contacts first bounce apart, and this arc melts adjacent surface portions of the contacts so that when they reengage, a molten zone is present at the interface. When arcing ceases following reengagement, the energy input into the contact interface drops sharply, and the zone at the interface thus quickly cools to a solid state. The result is the formation of a weld between the two contacts. The higher the arcing current, the larger the surface area that will be covered by the molten zone and hence the larger and stronger the weld ordinarily will be.

We have found that with contacts made from vacuum-cast and extruded beryllium as above described, the above-described weld between the contacts is very weak even for high arcing currents. This high resistance to contact-welding enables us to form the entire arcing portion of each contact of the same material. This is highly advantageous because this entire arcing portion can be of a single piece of metal, as contrasted to most prior designs where the contact-making region 30 is of a different metal from the rest of the contact and must therefore be provided by a separate piece joined to the rest of the contact. Not only is such joining expensive and time-consuming, but this extra part can be a source of arc-generated vapors of such a character as to detract from the interrupting capacity that would be available if only the remaining metal was present. As pointed out hereinabove, our interrupter can successfully interrupt currents of 30,000 amperes r.m.s. and much higher. The contacts of an interrupter rated for interrupting such high currents are typically subjected to relatively high mechanical loads which they must be able to sustain without damage. Contacts of cast beryllium that have not been subjected to hot working, as through extrusion, are too brittle to meet this requirement as it exists in an interrupter rated at 30,000 amperes r.m.s. or more. But our interrupter can easily meet this requirement for ratings of 30,000 amperes and even much more.

Another property of the above-described vacuum-cast, extruded beryllium that makes it an exceptional vacuum interrupter contact material is its excellent voltage-withstand ability. Under most conditions, a vacuum gap between contacts of this material can withstand a voltage at least 50 percent greater than is withstandable by a vacuum gap of the same length between similar contacts of copper having annular contact-making regions 30 of copper-bismuth (0.5 percent bismuth).

While our preferred embodiment utilizes beryllium derived from an ingot that has been vacuum cast, it is to be understood that such ingot could be produced by other melting or refining techniques, provided such techniques produce a high purity ingot that has a microstructure characterized by grain boundaries that are substantially free of oxide coating on the interfaces between the grains. One example of such a technique is zone refining either in a vacuum or in an inert environment, such as argon. Another example is casting as previously described except in an inert environment such as argon, instead of a vacuum. The ingot that results from any of these processes is then jacketed and hot worked as above described to produce a slab, bar or other hot-worked form from which the circular contact discs are cut. As in the previously described example, the microstructure of the hotworked beryllium is characterized by generally equiaxed grains much smaller in average size than the grains of a cast ingot of this material in its as-cast form prior to said hot-working.

While we have shown and described particular embodiments of our invention, it will be obvious to those skilled in the art that various changes and modifications may be made without departing from our invention in its broader aspects; and we, therefore, intend in the appended claims to cover all such changes and modifications as fall within the true spirit and scope of our invention.

What we claim as new and desire to sercure by Letters Patent of the United States is:

1. A vacuum-type circuit interrupter rated for interrupting currents of 30,000 amperes r.m.s. and higher comprising:

a. a highly evacuated envelope, b. a pair of separable contacts within said envelope that are relatively movable between engaged and disengaged positions, c. said contacts having arcing portions between which arcs are formed upon disengagement of said contacts, said arcing portions including arc-initiation regions between which said arcs are initiated upon contact-disengagement, d. said arcing portions being of a material consisting essentially of beryllium formed from an ingot cast in an inert environment, which ingot has been subject to hot working to produce a microstructure that is characterized by grains much smaller on the average than the average grain size of the as-cast ingot.

2. A vacuum type circuit interrupter as defined in claim 1 in which said beryllium of said arcing portions has a microstructure characterized by grain boundaries that are substantially free of oxide coating on the interfaces between the grains.

3. A vacuum type circuit interrupter as defined in claim 1 in which circuit-making occurs on said arc-initiation regions when the circuit interrupter is operated into its closed position, the arc-initiation region of each contact being integral with the remainder of the arcing portion of said contact and of the material defined in (d) of claim 1.

4. A vacuum type circuit interrupter as defined in claim 3 in which: said beryllium of said arcing portions has a microstructure characterized by grain boundaries that are substantially free of oxide coating on the interfaces between the grains.

5. The vacuum interrupter of claim 1 in which said inert environment of (d) in claim 1 is a vacuum and said hot working of (d) in claim 1 is extrusion.

6. The vacuum interrupter of claim 1 in which:

a. each of said contacts is a disc of said beryllium material, b. each of said discs is mounted on a contact-supporting rod and extends radially outward beyond the outer perimeter of said rod, and c. each of said discs is at least one-fourth inch in thickness considered longitudinally of said rods.

7. A vacuum type circuit interrupter rated for interrupting currents of 30,000 amperes r.m.s. and higher comprising:

a. a highly-evacuated envelope, b. a pair of separable contacts within said envelope that are relatively movable between engaged and disengaged positions, c. said contacts having arcing portions between which arcs are formed upon disengagement of said contacts, said arcing portions including arc-initiation regions between which said arcs are initiated upon contact-disengagement, d. said arcing portions being of a material consisting essentially of beryllium formed from an ingot having a microstructure characterized by grain boundaries that are substantially free of oxide coating on the interfaces between the grains, which ingot has been subject to hot working to produce a microstructure further characterized by grains much smaller on the average than the grains of a cast ingot of beryllium in its as-cast form prior to such hot working.

8. The vacuum interrupter of claim 2 in which said material contains about 0.01 to 0.03 percent by weight of beryllium oxide based on the weight of said beryllium distributed throughout said material.

9. The vacuum interrupter of claim 1 in which said material contains beryllium oxide in an amount of less than about 0.1 percent by weight of the beryllium.

10. The vacuum interrupter of claim 2 in which said material contains beryllium oxide in an amount of less than about 0.1 percent by weight of the beryllium.

11. The vacuum interrupter of claim 3 in which said material contains beryllium oxide in an amount of less than about 0.1 percent by weight of the beryllium.

12. The vacuum interrupter of claim 5 in which said material contains beryllium oxide in an amount of less than about 0.1 percent by weight of the beryllium.

13. The vacuum interrupter of claim 6 in which said material contains beryllium oxide in an amount of less than about 0.1 percent by weight of the beryllium.

14. The vacuum interrupter of claim 7 in which said material contains beryllium oxide in an amount of less than about 0.1 percent by weight of the beryllium.

* * * * *